US010760243B2

(12) United States Patent
Kumbhar et al.

(10) Patent No.: US 10,760,243 B2
(45) Date of Patent: Sep. 1, 2020

(54) WORK TOOL ATTACHMENT FOR A WORK MACHINE

(71) Applicant: DEERE & COMPANY, Moline, IL (US)

(72) Inventors: Nilesh T. Kumbhar, Karad (IN); Brett Graham, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 16/213,625

(22) Filed: Dec. 7, 2018

(65) Prior Publication Data

US 2020/0181871 A1 Jun. 11, 2020

(51) Int. Cl.

| | |
|---|---|
| ***E02F 3/76*** | (2006.01) |
| ***E02F 3/96*** | (2006.01) |
| ***B66F 9/065*** | (2006.01) |
| ***B66F 9/22*** | (2006.01) |
| ***E02F 3/84*** | (2006.01) |

(52) U.S. Cl.

CPC ..... *E02F 3/7609* (2013.01); *B66F 9/065* (2013.01); *B66F 9/22* (2013.01); *E02F 3/7613* (2013.01); *E02F 3/7618* (2013.01); *E02F 3/844* (2013.01); *E02F 3/96* (2013.01)

(58) Field of Classification Search

CPC ..... E02F 3/7609; E02F 3/7613; E02F 3/96

See application file for complete search history.

(56) References Cited

U.S. PATENT DOCUMENTS

| | | | | |
|---|---|---|---|---|
| 2,109,392 A * | 2/1938 | Le Bleu | E02F 3/7609 | 172/812 |
| 2,421,472 A * | 6/1947 | Way | B66F 9/06 | 414/629 |
| 2,634,519 A * | 4/1953 | Merz | E02F 3/7613 | 172/821 |
| 2,702,952 A * | 3/1955 | Le Tourneau | E02F 3/7613 | 172/823 |
| 4,405,019 A * | 9/1983 | Frisbee | E02F 3/7613 | 172/816 |
| 5,010,961 A * | 4/1991 | Frisbee | E02F 3/7613 | 172/821 |
| 5,484,250 A | 1/1996 | Gilmore, Jr. et al. | | |
| 5,829,337 A | 11/1998 | Barden | | |

(Continued)

FOREIGN PATENT DOCUMENTS

GB 2037848 A * 7/1980 ..... E02F 3/7613

*Primary Examiner* — Tara Mayo-Pinnock

(57) ABSTRACT

A work machine extending in a fore-aft direction comprising a frame and a ground-engaging mechanism, the ground-engaging mechanism configured to support the frame on a ground surface; a boom assembly coupled to the frame, the boom assembly having a pair of boom arms pivotally coupled to the frame; and an attachment coupled to a fore-section of the boom arms. The attachment may comprise a guide rigidly coupled to a fore-section of the frame; a movable member coupled to the guide, the movable member moveable relative to the frame by a pair of hydraulic cylinders, the guide restricting movement of the movable member in a non-vertical direction; and a work tool coupled to the movable member wherein actuating the pair of hydraulic cylinders engages the movable member, vertically lifting or lowering the work tool relative to the frame.

10 Claims, 7 Drawing Sheets

(56) References Cited

U.S. PATENT DOCUMENTS

| | | | |
|---|---|---|---|
| 6,477,964 | B1 | 11/2002 | Tygard |
| 7,204,656 | B2 | 4/2007 | Bjuhr |
| 8,118,111 | B2 | 2/2012 | Armas |
| 9,643,826 | B2 | 5/2017 | Kaneko et al. |
| 9,656,840 | B2 | 5/2017 | Oiwa et al. |
| 10,533,300 | B1 | 1/2020 | Armas |
| 2017/0145654 | A1 | 5/2017 | van Amelsfoort et al. |
| 2017/0369295 | A1 | 12/2017 | Tygard |
| 2018/0179735 | A1 | 6/2018 | Newlin et al. |

* cited by examiner

WORK TOOL ATTACHMENT FOR A WORK MACHINE

CROSS-REFERENCE TO RELATED APPLICATIONS

N/A

FIELD OF THE DISCLOSURE

The present disclosure relates to an improved work tool attachment configured for use with a work machine.

BACKGROUND

Work machines, including crawler dozers, loaders, excavators, utility vehicles, tractors, and road pavers, to name a few, are generally vehicles comprising a boom that can be manipulated to perform a variety of functions. One of the challenges in the use of work machines are the large number of different work machines with their respective functions, control systems, user input parameters, standardized attachments, and their respective dependencies. Another challenge is that typically a plurality of different attachments catered towards different functionalities may be coupled with several work machines.

Various issues exist for this problem. Operators of skid steers, crawler dozers, loaders and track loaders, for example, perform a myriad of functions using different attachments, using hand and/or foot controls on the user input interface. Both compact track loaders and crawler dozers have the ability to couple to a variety of attachments wherein some attachments may be of standardized use on one work machine, and another attachment may be of standardized use on another work machine. Furthermore, both work machines differ in size and maneuverability thereby impacting the work environments each respective machine is capable of accessing, and functioning in. When an attachment, such as a blade commonly found on a crawler dozer, is coupled to a compact track loader, the blade is not raised or lowered in a perfectly vertical line with respect to the work machine, or the frame of the work machine, due to the geometry of linkage. Instead, a point on blade would trace a curve as blade is lifted or lowered, thereby creating a inefficiencies in control of the blade attachment, especially with gauging depth control. Therein lies a need to facilitate quick adaptation of an attachment for a work machine based on the attachment type, wherein operator use becomes simplified. The following disclosure addresses this issue.

SUMMARY

This summary is provided to introduce a selection of concepts that are further described below in the detailed description and accompanying drawings. This summary is not intended to identify key or essential features of the appended claims, nor is it intended to be used as an aid in determining the scope of the appended claims.

The present disclosure includes an apparatus for a work tool attachment for a work machine, and a work machine.

The work machine may comprise of a frame and a ground-engaging mechanism, the ground-engaging mechanism configured to support the frame on a surface; a boom assembly coupled to the frame, the boom assembly having a pair of boom arms pivotally coupled to the frame; and an attachment coupled to a fore-section of the boom arms. The attachment may comprise of a guide rigidly coupled to a fore-section of the frame, a movable member coupled to the guide, and a work tool. The moveable member may move relative to the frame by a pair of hydraulic cylinders. The guide may restrict movement of the movable member in a non-vertical direction. The work tool may be coupled to the movable member, wherein actuating the pair of hydraulic cylinders engages the moveable member, vertically lifting or lowering the work tool relative to the frame.

The guide may comprise of a vertical support surface, the vertical support surface perpendicular to a fore-aft direction. The movable member may abut the vertical support surface when the pair of hydraulic cylinders actuate in vertically lifting or lowering the work tool.

In one embodiment, the pair of hydraulic cylinders may comprise of a pair of tilt hydraulic cylinders. The first section of the pair of tilt hydraulic cylinders pivotally coupled to the frame and the second section of the pair of tilt hydraulic cylinders pivotally coupled to the movable member.

In a second embodiment, the guide may comprise of a casing. The casing may comprise of a pair of vertical beams and the pair of hydraulic cylinders, wherein the pair of hydraulic cylinders comprises of a pair of vertically-oriented auxiliary hydraulic cylinders. The movable member may be coupled to the pair of vertical beams to restrict movement of the movable member in the non-vertical direction.

The attachment may further comprise auxiliary hydraulic cylinders, wherein the auxiliary hydraulic cylinders performs one or more of tilting the work tool relative to the frame in a direction of roll about a forward portion of the boom assembly and angling the work tool relative to the frame in a direction of yaw about the forward portion of the boom assembly.

The boom arms may remain locked in a lowered position.

The work tool may be one of a blade or a fork.

These and other features will become apparent from the following detailed description and accompanying drawings, wherein various features are shown and described by way of illustration. The present disclosure is capable of other and different configurations and its several details are capable of modification in various other respects, all without departing from the scope of the present disclosure. Accordingly, the detailed description and accompanying drawings are to be regarded as illustrative in nature and not as restrictive or limiting.

BRIEF DESCRIPTION OF THE DRAWINGS

The detailed description of the drawings refers to the accompanying figures in which.

DETAILED DESCRIPTION

The embodiments disclosed in the above drawings and the following detailed description are not intended to be exhaustive or to limit the disclosure to these embodiments. Rather, there are several variations and modifications which may be made without departing from the scope of the present disclosure.

As used herein, unless otherwise limited or modified, lists with elements that are separated by conjunctive terms (e.g., "and") and that are also preceded by the phrase "one or more of or" at least one of indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

As used herein, "based on" means "based at least in part on" and does not mean "based solely on," such that it neither excludes nor requires additional factors.

Figure 1:
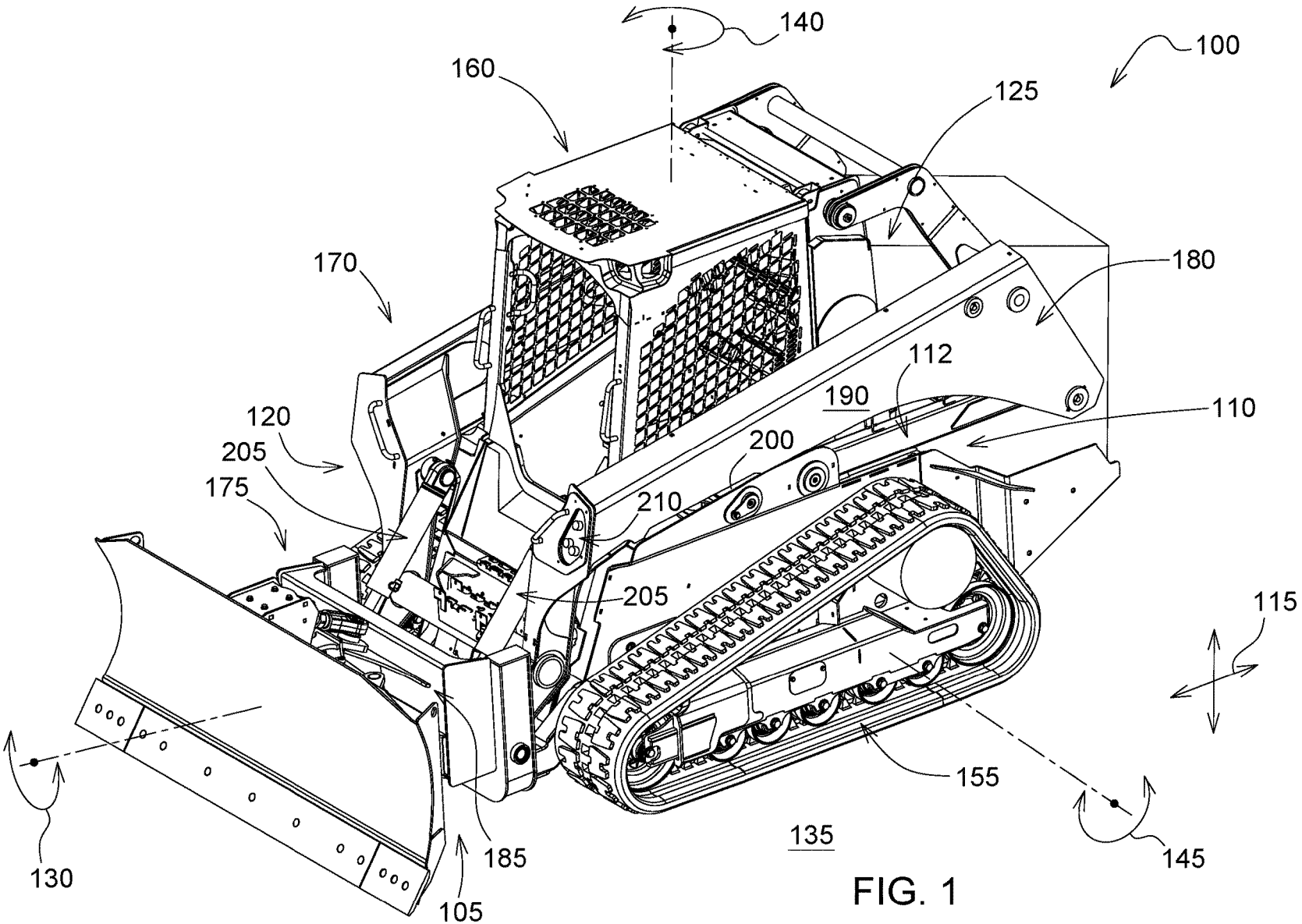
FIG. 1 is a perspective view of a compact track loader work machine according to a first embodiment of the present disclosure.

FIG. 1 illustrates a work machine 100, extending in a fore-aft direction 115, depicted as a compact track loader with an attachment 105 operatively coupled to the work machine 100 according to a first embodiment 375. It should be understood, however, that the work machine could be one of many types of work machines, including, and without limitation, a skid steer, a backhoe loader, a front loader, a bulldozer, and other construction vehicles. The work machine 100, as shown, has a frame 110, having a fore-section 120, or portion, and a rear-end portion 125. The work machine includes a ground-engaging mechanism 155 that supports the frame 110 and an operator cab 160 supported on the frame 110, the ground-engaging mechanism 155 configured to support the frame 110 on the ground surface 135.

The engine 165 (shown in FIG. 2) is coupled to the frame 110 and is operable to move the work machine 100. The illustrated work machine 100 includes tracks, but other embodiments may include one or more wheels that engage the ground surface 135. Work machine 100 may be operated to engage the ground surface 135 and cut and move material to achieve simple or complex features on the surface. As used herein, directions with regard to work machine 100 may be referred to from the perspective of an operator seated within the operator cab 160; the left of work machine 100 is to the left of such an operator, the right of work machine is to the right of such an operator, the front or fore of work machine is the direction such an operator faces, the rear or aft of work machine is behind such an operator, the top of work machine is above such an operator, and the bottom of work machine below such an operator. In order to turn, the ground-engaging mechanism 155 on the left side of the work machine may be operated at a different speed, or in a different direction, from the ground-engaging mechanism 155 on the right side of the work machine 100. In a conventional compact track loader, the operator can manipulate controls from inside an operator cab 160 to drive the tracks on the right or left side of the work machine 100. The movement for work machine 100 may be referred to as roll 130 or the roll direction, pitch 145 or the pitch direction, and yaw 140 or the yaw direction.

The work machine 100 comprises a boom assembly 170 coupled to the frame 110. An attachment 105, or work tool 320, may be pivotally coupled at a forward portion 175 of the boom assembly 170, while a rear portion 180 of the boom assembly 170 is pivotally coupled to the frame 110. The frame 110 comprises a mainframe 112 and a track frame 114 (alternative embodiments comprising other work machines may have other ground-engaging frames). The attachment 105 may be coupled to the boom assembly 170 through an attachment coupler 185, which may a Deere and Company's Quik-Tatch, which is an industry standard configuration and a coupler universally applicable to many Deere attachments and several after-market attachments. The attachment coupler 185 may be coupled to a distal section of the boom arms 190, or more specifically the forward portion 175 of the boom assembly 170.

The boom assembly 170 comprises a first pair of boom arms 190 (one each on a left side and a right side) pivotally coupled to the frame 110 and moveable relative to the frame 110 by a pair of boom hydraulic cylinders 200, wherein the pair of boom hydraulic cylinders 200 may also conventionally be referred to as a pair of lift cylinders (one coupled to each boom arm) for a compact track loader. The attachment coupler 185 may be coupled to a forward section 175, or portion, of the pair of boom arms 190, being moveable relative to the frame 110 by a pair of tilt hydraulic cylinders 205. The frame 110 of the work machine 100 further comprises a hydraulic coupler 210 on the fore-section 120 of the work machine 100 to couple one or more auxiliary hydraulic cylinders 215 (shown in FIG. 2) to drive movement of or actuate auxiliary functions of an attachment 105. The attachment coupler 185 enables the mechanical coupling of the attachment to the frame 110. The hydraulic coupler 210, contrary to the attachment coupler 185, enables the hydraulic coupling of an auxiliary hydraulic cylinder(s) 215 on the attachment 105 to the hydraulic system 220 (shown in FIG. 2) of the work machine 100. Please note that not all attachments have one or more auxiliary hydraulic cylinders and therefore will not use the hydraulic coupler 210. Alternatively uses for the hydraulic coupler 210 include opening or closing a grapple type attachment, or spinning a roller brush type attachment. In the embodiment described in detail below, the hydraulic coupler 210 is used in conjunction with an attachment 105, the attachment in the present embodiment comprising a work tool 320, a blade 322, to mimic the function of a dozer crawler.

Each of the pair of boom hydraulic cylinders 200, the pair of tilt hydraulic cylinders 205, and the auxiliary cylinders 215 (found on the attachments of embodiments shown herein) are double acting hydraulic cylinders. One end of each cylinder may be referred to as a head end, and the end of each cylinder opposite the head end may be referred to as a rod end. Each of the head end and the rod end may be fixedly coupled to another component, such as a pin-bushing or pin-bearing coupling, to name but two examples of pivotal connections. As a double acting hydraulic cylinder, each may exert a force in the extending or retracting direction. Directing pressurized hydraulic fluid 235 into a head chamber of the cylinders will tend to exert a force in the extending direction, while directing pressurized hydraulic fluid 235 into a rod chamber of the cylinders will tend to exert a force in the retracting direction. The head chamber and the rod chamber may both be located within a barrel of the hydraulic cylinder, and may both be part of a larger cavity which is separated by a moveable piston connected to a rod of the hydraulic cylinder. The volumes of each of the head chamber and the rod chamber change with movement of the piston, while movement of the piston results in extension or retraction of the hydraulic cylinder. The control of these cylinders will be described in further detail with regards to FIG. 2.

Figure 2:
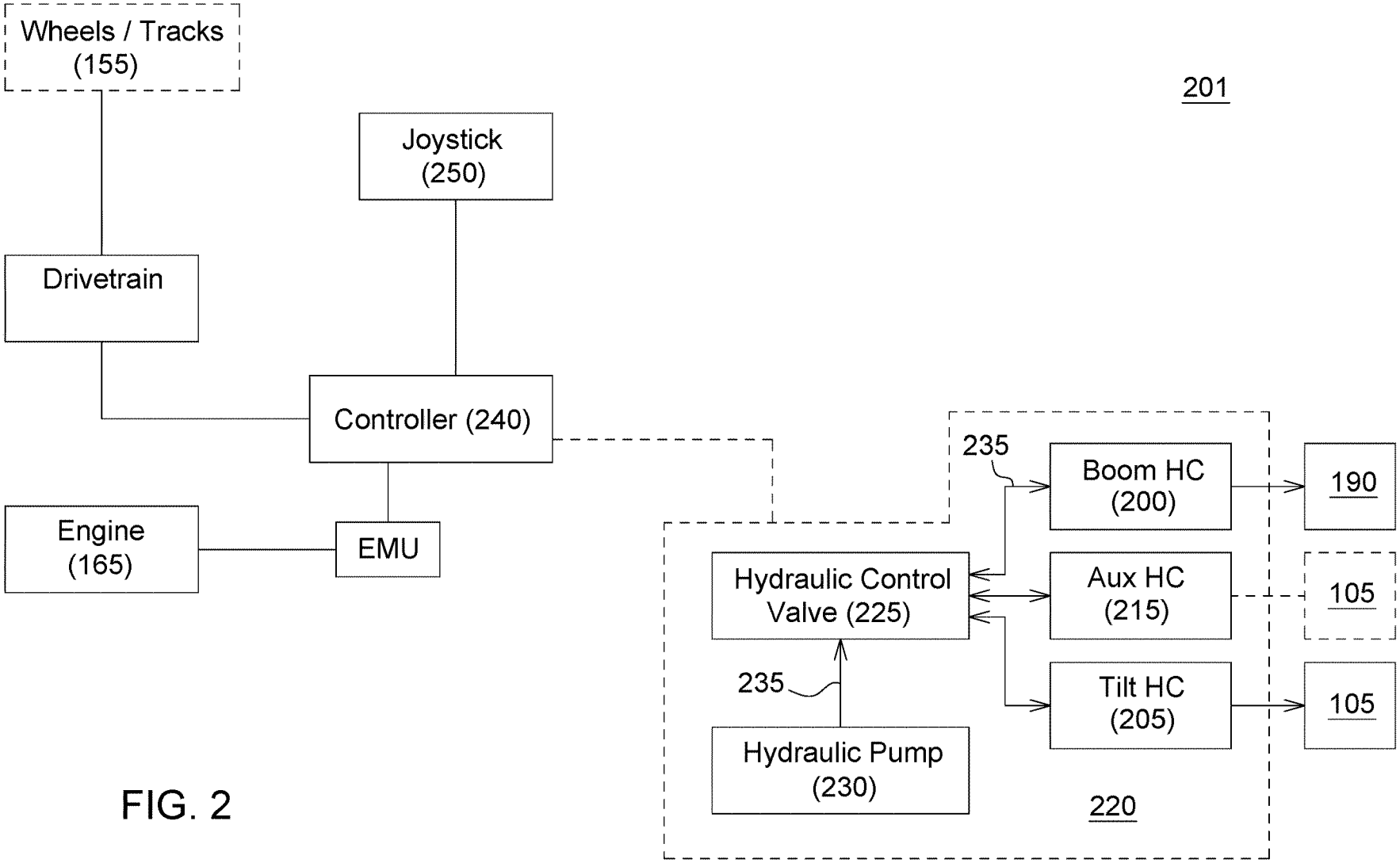
FIG. 2 is a schematic of the hydraulic system and other parts of the compact track loader of FIG. 1, according to the embodiments disclosed herein.

FIG. 2 is a schematic of a portion of an attachment-configurable system 201 for controlling the hydraulic cylinders (200, 205, 215) as it relates to the components of the work machine 100 of FIG. 1, the system including hydraulic and electrical components. Each of the pair of boom hydraulic cylinders 200, pair of tilt hydraulic cylinders 205, and the auxiliary hydraulic cylinder(s) 215 are coupled to hydraulic control valve 225, which may be positioned in a portion of the work machine 100. Hydraulic control valve 225 may also be referred to as a valve assembly or manifold. Hydraulic control valve 225 receives pressurized hydraulic fluid 235 from hydraulic pump 230, which generally may be coupled to the engine 165 or alternative power source, and directs such hydraulic fluid 235 to the pair of boom hydraulic cylinders 200, the pair of tilt hydraulic cylinders 205, the auxiliary hydraulic cylinder(s) 215, and other hydraulic circuits or functions of the work machine (e.g. the hydrostatic drive motors for the left and right-side tracks). Hydraulic control valve 225 may meter such fluid out, or control the flow rate of hydraulic fluid 235 to each hydraulic circuit to which it is connected. Alternatively, hydraulic control valve 225 may not meter such fluid out but may instead only selectively provide flow to these functions while metering is performed by another component (e.g. a variable displacement hydraulic pump). Hydraulic control valve 225 may meter such fluid out through a plurality of flow paths or spools, whose positions control the flow of hydraulic fluid 235, and other hydraulic logic. The spools may be actuated by solenoids, pilots (e.g. pressurized hydraulic fluid acting on the spool), the pressure upstream or downstream of the spool, or some combination of these or other uses. The controller 240 of the work machine 100 actuates these solenoids by sending a specific current to each (e.g. 600 mA). In this way, the controller 240 may actuate an attachment 105 by issuing electrical command signals to direct hydraulic fluid 235 flow from the hydraulic pump 230 to one or more of the pair of boom hydraulic cylinders 200, the pair of tilt hydraulic cylinders 205, and the auxiliary cylinder(s) 215.

Controller 240, which may be referred to as a vehicle control unit (VCU), is in communication with a number of components on the work machine 100, including the hydraulic system 220, electrical components such as operator inputs from within the operator cab 160, and other components. Controller 240 is electrically coupled to these other components by a wiring harness such that messages, commands, and electrical power may be transmitted between controller 240 and the remainder of the work machine 100. Controller 240 may be coupled to other controllers, such as the engine control unit (ECU), through a controller area network (CAN). Controller may then send and receive messages over the CAN to communicate with other components of the CAN. The controller 240 may send command signals to actuate the attachment 105 by sending a command signal to actuate an input from the user input interface, shown as joystick 250, from the operator cab 160 (shown in FIG. 1). For example, an operator may use a joystick 250 to issue command to actuate an attachment 105, and the joystick 250 may generate hydraulic pressure command signals communicated to hydraulic control valve 225 to cause actuation of the attachment 105. In such a configuration, controller 240 may be in communication with electrical devices (solenoids, motors) which may be actuated by a joystick 250 in operator cab 160. Other alternative inputs on a user input interface with electric, or hydraulic pressure command signals include switches, buttons, roller tabs, sliding tabs, infinity switches, touchscreens, foot pedals, virtual operative signaling, to name a few.

The hydraulic system 220, communicatively coupled to the controller 240, is configured to operate the work machine 100 and operate the attachment 105 coupled to the work machine 100, including, without limitation, the attachment's lift mechanism, tilt mechanism, pitch mechanism, roll mechanism, and auxiliary mechanisms, for example. This may also include moving the work machine 100 in forward and reverse directions, moving the work machine left and right, and controlling the speed of the work machine's travel. Summarily, the hydraulic pump 230 may be coupled to one or more of the pair of boom hydraulic cylinders 200, the pair of tilt hydraulic cylinders 205, and auxiliary hydraulic cylinder(s) 215. The auxiliary hydraulic cylinder(s) 215 may actuate an attachment 105. The hydraulic pump 230 may deliver hydraulic fluid 235 through the plurality of flow paths, the plurality of flow paths coupled to one or more of the pair of boom hydraulic cylinders 200, the pair of tilt hydraulic cylinder 205, and the auxiliary hydraulic cylinder(s) 215.

Now turning to FIGS. 3 through 6, with continued reference to FIGS. 1 and 2, the work machine 100 comprises an attachment 105 coupled to a forward section 193 of the boom arms 190 and moveable relative to the frame 110 by a pair of hydraulic cylinders (this will vary depending on the embodiment). The attachment 105 may comprise a guide 400 rigidly coupled to a fore-section 120 (shown in FIG. 1) of the frame 110 and a movable member 485 coupled to the guide 400 wherein the guide 400 restricts movement of the movable member 485 in a non-vertical direction. The vertical direction 305 can be defined as the direction perpendicular to the ground surface 135 wherein the surface is flat. A non-vertical direction can be any direction other than the vertical direction 305 (e.g. along the width-wise direction of the work machine, or the length-wise direction of the work machine, that is the fore-aft direction 115). The vertical direction is also shown as the dotted arrow 305, defined as a true vertical or a substantially true vertical. Actuating the pair of hydraulic cylinders (tilt hydraulic cylinders 205 for the first embodiment 375 shown in FIG. 3 and auxiliary hydraulic cylinders 215 for the second embodiment 390 shown in FIG. 5) engages the movable member 485, vertically lifting or lowering the work tool 105 relative to the frame 110, wherein the work tool 105 is coupled to the movable member 485.

Figure 3:
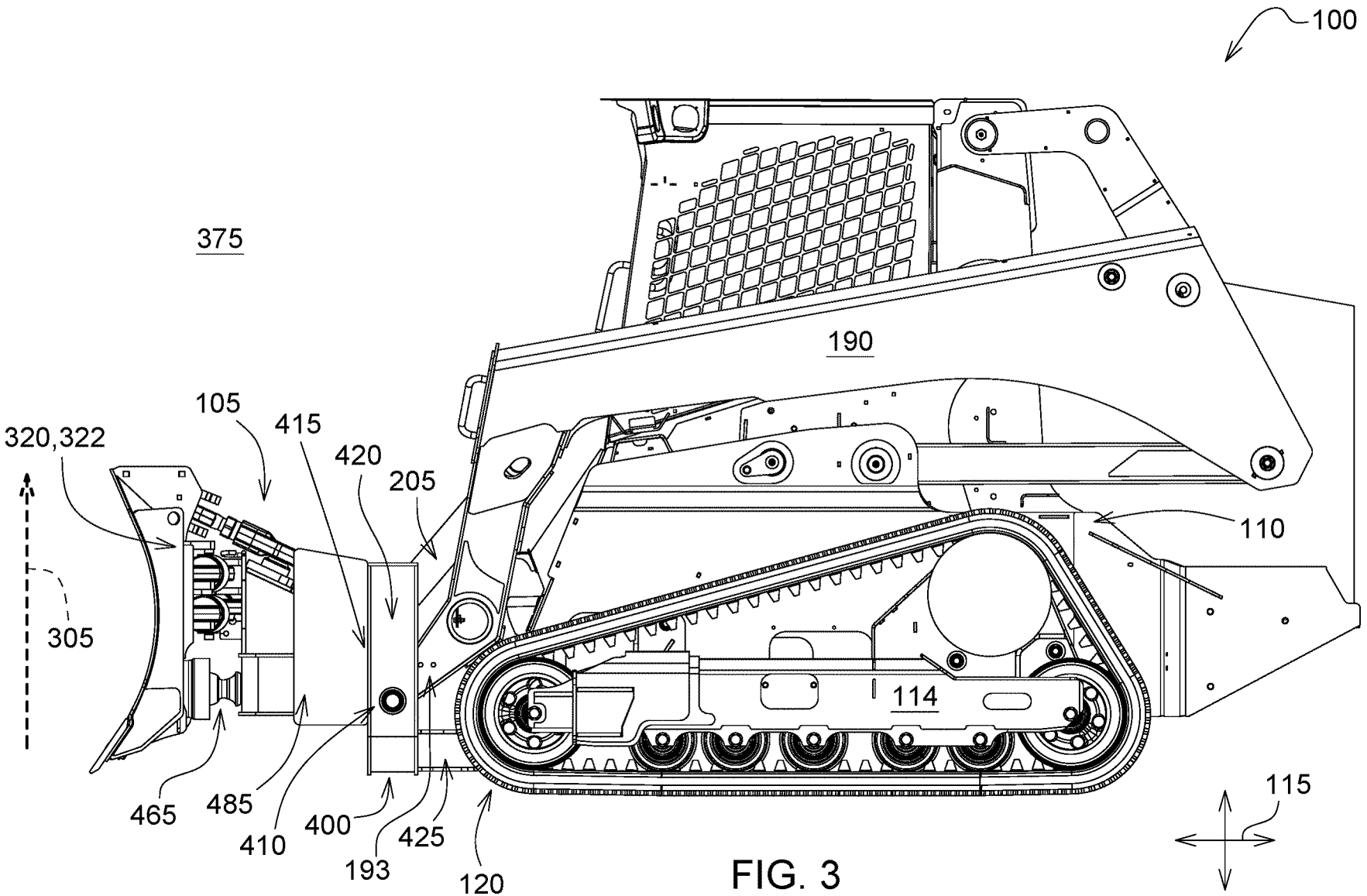
FIG. 3 is a side view of the embodiment disclosed in FIG. 1 with the tilt cylinders retracted, wherein a portion of the attachment side-view is cross-sectioned.
Figure 4:
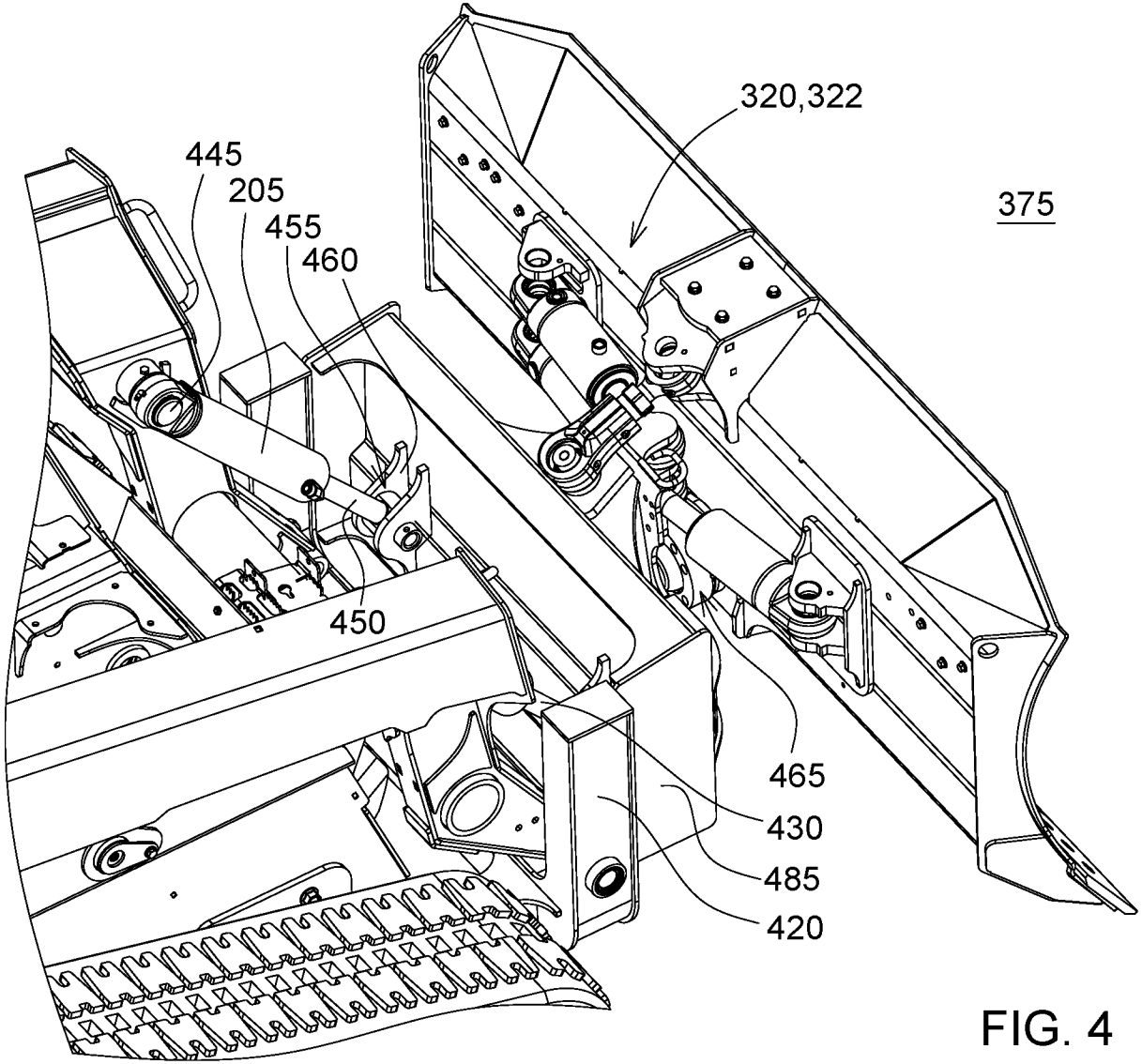
FIG. 4 is a portion of the work machine with the perspective back view of the attachment according to the first embodiment shown in FIG. 1.

In the first embodiment 375, shown in FIGS. 3 and 4, the guide 400 comprises of a vertical support surface 410. The vertical support surface 410 may be parallel to the vertical direction 305. Although the vertical support surface 410 shown is a fore surface of the guide 400, in an alternative embodiment the vertical support surface may be an aft surface of the guide 400. The movable member 485, or a surface 415 of the movable member 485, may abut the vertical support surface 410 when the pair of hydraulic cylinders (i.e. the tilt hydraulic cylinders 205 in the first embodiment 375) actuate in vertically lifting or lowering the work tool 320. The tilt hydraulic cylinders 205 are integrated with the work machine 100, wherein the tilt hydraulic cylinders 205 are part of the original work machine as manufactured, and not an auxiliary component. The guide 400 comprising the vertical support surface 410 is not restricted to any particular shape, provided it comprises a vertical support surface 410 and is coupled to the frame 110 of the work machine 100. As shown in FIG. 3 of the first embodiment 375, the guide 400, which is detachably coupled to the frame of the work machine is generally L-shaped as viewed from the side and comprises a vertical portion 420 such as a rigid beam of steel or other strong material and a horizontal portion 425 such as another rigid beam which extends forward from the fore-section 120 of the frame 110. In this first embodiment 375, the horizontal portion 425 is coupled to the track frame 114 portion, or undercarriage, of the frame 110. Track frame 114 in the context of this disclosure may refer to the frame portion of the ground-engaging mechanism 155 such as the frame 110 supporting the track of the compact track loader, or alternatively ground-engaging wheels of a skid steer (not shown). Coupling directly to the frame 110 advantageously allows the reactive forces encountered by the attachment 105, or blade 322 as it grades the surface, to substantially or in a greater amount transmit through the frame 110 (may also be referred to as the undercarriage) of the work machine 100 as opposed through the boom arms 190. The frame 110 of the work machine 100 spans a larger cross-sectional area in addition to having a shock absorbing system (e.g. springs, dampeners throughout) to absorb the reactive forces. Furthermore, the frame 110 provides the improved stiffness for effective dozing performance. During a grading operation, the compact track loader is forwarded so that the work tool 320 coupled to the movable member 485, shown as a blade 322 is driven into earth, stones, gravel or similar material. In one exemplary embodiment, the blade 322 is operated optimally at a pitch angle of approximately 56 degrees relative to the ground surface 135 for efficient grading. This optimal pitch angle will vary based on the conditions of the ground surface 135 (e.g. moisture, hardness, stickiness). Please note this angle may be modified prior to using the work machine by a pitch link, or of a similar mechanism. This angling of the blade 322 subjects the work machine 100 to a counterforce from the load presented by engaging ground material. Coupling directly to the frame 110 provides an alternative load path for the reactive forces to be dispersed. Coupling the attachment 105 to the frame 110 of the work machine 100 reduces the reactive forces and stress on the ball joint 465 or any other means of coupling the attachment 105 to the work machine 100, thereby increasing the working life of the coupling mechanism (e.g. the attachment coupler 185, or the ball joint 465 of the coupling mechanism) and increases the stability of the blade 322 or the useful life of the blade 322.

Figure 5:
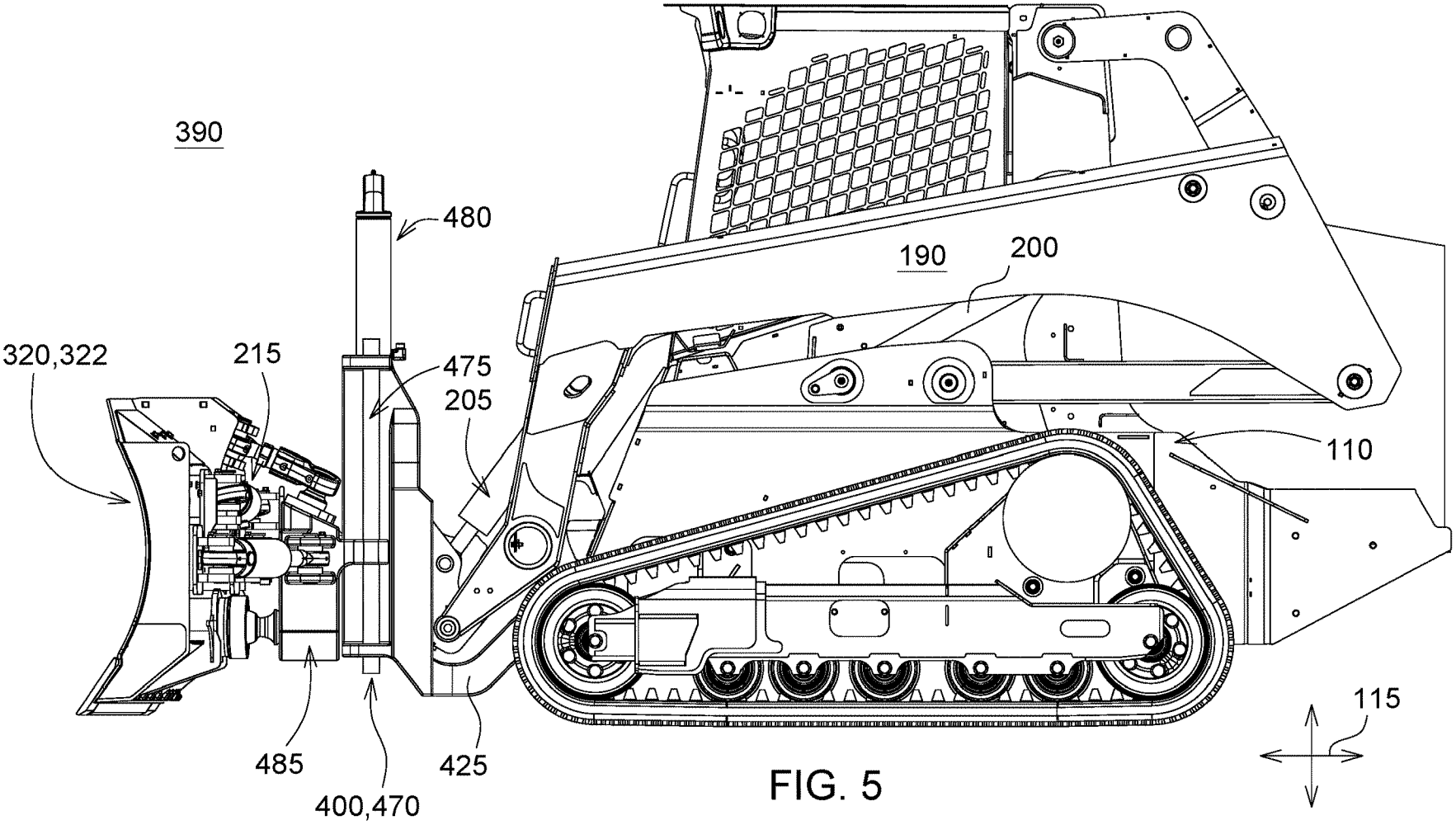
FIG. 5 is a side view of a second embodiment disclosed, wherein a portion of the attachment side-view is cross-sectioned.

In both the first embodiment 375 and the second embodiment 390, the stiffness is improved for effective dozing performance by coupling the guide 400 directly to the frame 110 as shown in FIGS. 3 and 5.

An opening 430 to provide visibility for the operator of the work machine may be formed in the guide 400, or more particularly the vertical portion 420 of the guide comprising the vertical support surface 410. The vertical support surface 410 is shown coupled on the work machine 100 with the widthwise center of the vertical support surface 410 coinciding with the widthwise center of the work machine 100 to ensure sufficient alignment with the pair of tilt hydraulic cylinders 205, but the horizontal portion 425 need not be centered with respect to the work machine 100. It is possible for the guide 400 to be integrated with the frame 110 so as to form a single member. However, it is convenient for the guide 400 to be detachably coupled to the frame 110 for a streamline surface. Furthermore, removing the guide 400 enables the work tool 320 to be removed from the work machine 100 when not needed to enable the work machine to engage with various types of other load engaging work tools 320 (e.g. blade 322, box blade, or fork 700) and other attachments 105.

In the first embodiment 275, the pair of hydraulic cylinders comprises of the pair of tilt hydraulic cylinders 205 integrated with the work machine (i.e. part of the boom assembly 170). The first section 445 of the pair of tilt hydraulic cylinders 205 is pivotally coupled to the frame 110 and the second section 450 of the pair of tilt hydraulic cylinders 205 is pivotally coupled to the movable member 485. In the embodiment shown in FIG. 4, the pivotal coupling of the second section 450 of each respective tilt hydraulic cylinders 205 restricts movement in the widthwise direction of the work machine 100 by comprising two raised walls 455 adjacent to each respective coupling shown in this embodiment as a hinge 460 (note only one of the two hinges is visible in FIG. 4) on the movable member 485. The movable member 485 may then be coupled to the work tool 320 (shown as a blade 322) through a ball joint 465 and possibly other auxiliary hydraulic cylinders 215, wherein the other set of auxiliary hydraulic cylinders 215 provide a means for moving the work tool 320 in other directions (discussed in more detail below).

Figure 6:
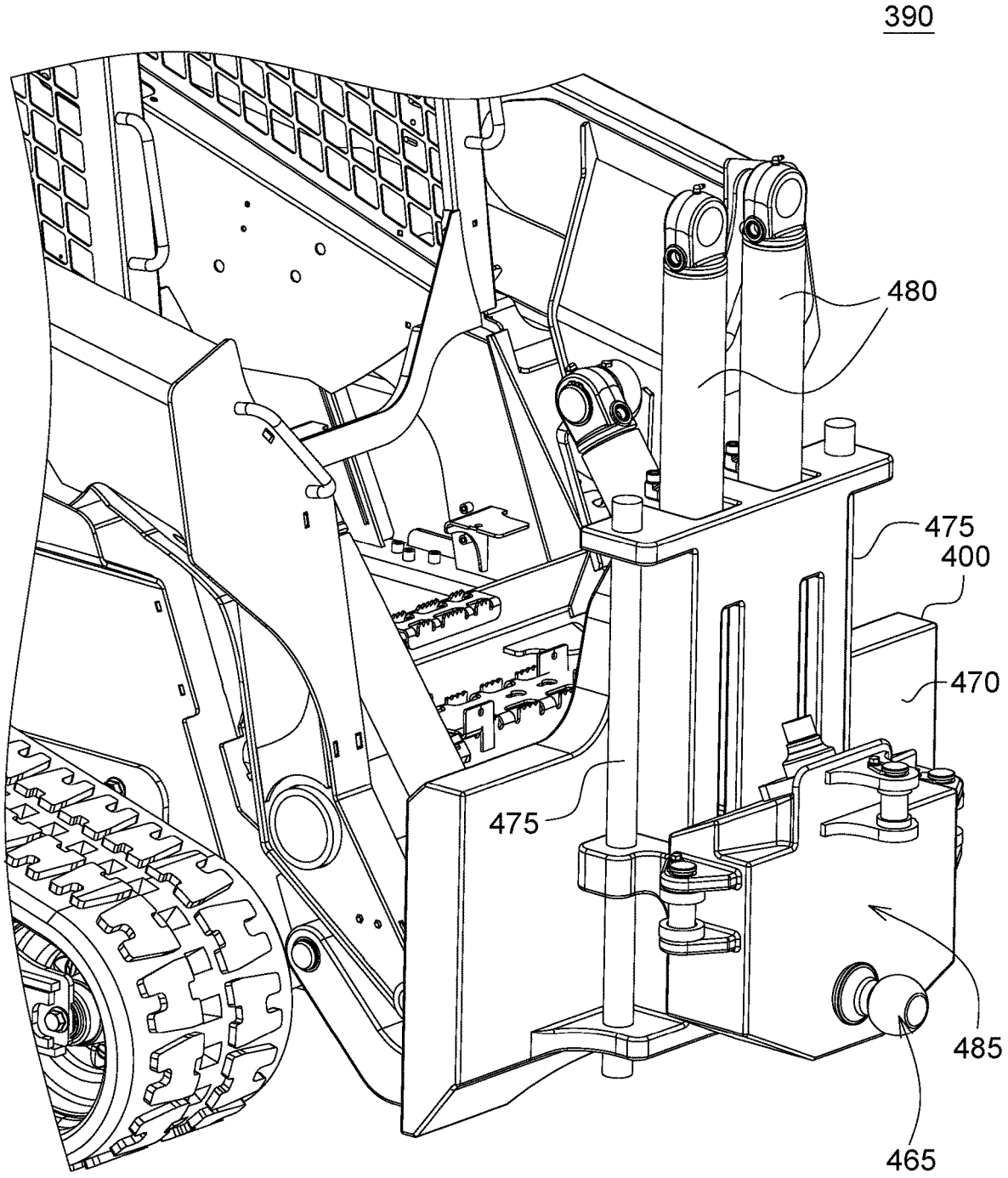
FIG. 6 is a portion of the attachment according to the second embodiment with a perspective front view.
Figure 7:
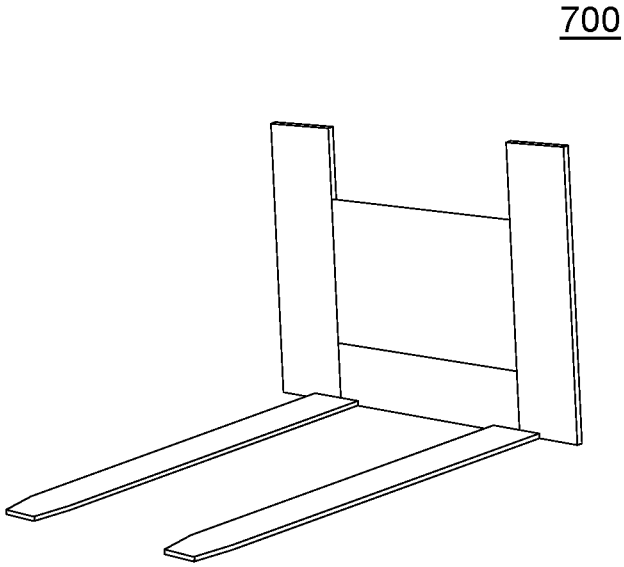
FIG. 7 is a schematic of a type of work tool, the fork.

In a second embodiment 390, shown in FIGS. 5 and 6, the guide 400 comprises of a casing 470. The casing 470 comprises of a pair of vertical beams 475 (only one of which is visible in FIG. 6) and a pair of hydraulic cylinders, wherein the pair of hydraulic cylinders comprise of a pair of vertically-oriented auxiliary hydraulic cylinders 480. A movable member 485 may be coupled to the pair of vertical beams 475, the vertical beams 475 restricting movement of the movable member 485 in a non-vertical direction. In the second embodiment 390, the pair of vertical beams 475 of the casing 470 are linear members, and the guide 400 supports the work tool 320 for substantially linear movement with respect to the frame 110, ignoring any deviation from a linear path caused by play between the vertical beams 475 of the casing 470 and the movable member 485 coupled to the work tool 320. The movable member 485 is further coupled to the vertically-oriented hydraulic cylinders 480 wherein actuating the vertically-oriented hydraulic cylinders engages the movable member 485, vertically lifting and lowering the work tool 320.

Similar to the first embodiment 273, the guide 400 of the second embodiment comprises a horizontal portion 425 coupled to a fore-section 120 (shown in FIG. 1) of the frame 110. The second embodiment 290 herein demonstrates the coupling to be to a track frame 114 of the frame 110, providing the same advantages as described above.

The attachment of either the first embodiment 375 and the second embodiment 390 may further comprise of auxiliary hydraulic cylinders 215, wherein actuating the auxiliary hydraulic cylinders 215 performs one or more of tilting the work tool relative to the work machine in a direction of roll about the forward portion of the boom assembly, and angling the work tool relative to the work machine in a direction of yaw about the forward portion of the boom assembly.

The boom arms 190 remain locked in a lowered position when the attachment 105 of the embodiments disclosed herein are coupled to the work machine 100. Locked in the lowered position may include one or more of a hydraulic lock and a mechanical lock. Keeping the boom arms 190 in a lowered position advantageously provides improved visibility for the operator of the blade 322, wherein visibility is expanded to side views (i.e. on a left and a right side of the work machine 100) when the boom arms 190 remain in the lowered position.

Because of the attachment's ability to raise and lower the work tool along a true vertical direction 305, appropriate work tools may include a blade 322, a fork 700. Movement of the work tool 320 to move in a true vertical direction 305 advantageously provides improved precision control for grading operations, improved control of a blade 322 angle during the raising and lowering of the blade 322, and the attachment configuration may increase its versality in use to extend to other work tools 320, such as a fork 700.

The work tool 320 of the present embodiments are a blade 322. The work tool 320 is an attachment which may engage the ground or material to move or shape it. Work tool 320 may be used to move material from one location to another and to create features on the ground, including flat area, grades, hills, roads, or more complexly shaped features. In the embodiment shown, the work tool 320 may be referred to as a six-way blade 322, six-way adjustable blade, or pitch-angle-tilt (PAT) blade. Work tool 320 may be hydraulically actuated to pitch upwards or downwards in the direction of pitch 145, roll left or roll right in the direction of roll 130 (which may be referred to tilt left and tilt right), and angle left or angle right in the direction of yaw 140 (which may be referred to as blade angle, or yaw left or yaw right). Alternative embodiments may utilize a work tool 320 with fewer hydraulically controlled degrees of freedom, such as a 4-way blade that may not be angled, or actuated in the direction of yaw 140.

The terminology used herein is for the purpose of describing particular embodiments or implementations and is not intended to be limiting of the disclosure. As used herein, the singular forms "a", "an" and "the" are intended to include the plural forms as well, unless the context clearly indicates otherwise. It will be further understood that the any use of the terms "has," "have," "having," "include," "includes," "including," "comprise," "comprises," "comprising," or the like, in this specification, identifies the presence of stated features, integers, steps, operations, elements, and/or components, but does not preclude the presence or addition of one or more other features, integers, steps, operations, elements, components, and/or groups thereof.

The references "A" and "B" used with reference numerals herein are merely for clarification when describing multiple implementations of an apparatus.

One or more of the steps or operations in any of the methods, processes, or systems discussed herein may be omitted, repeated, or re-ordered and are within the scope of the present disclosure.

While the above describes example embodiments of the present disclosure, these descriptions should not be viewed in a restrictive or limiting sense. Rather, there are several variations and modifications which may be made without departing from the scope of the appended claims.

What is claimed is:

1. A work machine extending in a fore-aft direction, the work machine comprising:

a frame and a ground-engaging mechanism, the ground-engaging mechanism configured to support the frame on a ground surface;

a boom assembly coupled to the frame, the boom assembly having a pair of boom arms pivotally coupled to the frame; and an attachment coupled to a fore-section of the boom arms, the attachment comprising:

a guide rigidly coupled to a fore-section of the frame, wherein the guide comprises of a vertical support surface, the vertical support surface perpendicular to the fore-aft direction;

a movable member coupled to the guide, the movable member moveable relative to the frame by a pair of hydraulic cylinders, the guide restricting movement of the movable member in a non-vertical direction, the movable member abutting the vertical support surface when the pair of hydraulic cylinders actuate in vertically lifting or lowering the work tool;

a work tool coupled to the movable member, wherein actuating the pair of hydraulic cylinders engages the movable member, vertically lifting or lowering the work tool relative to the frame, and wherein the pair of hydraulic cylinders comprises of a pair of tilt hydraulic cylinders, a first section of the pair of tilt hydraulic cylinders pivotally coupled to the frame and a second section of the pair of tilt hydraulic cylinders pivotally coupled to the movable member.

2. The work machine of claim 1, wherein the guide comprises of a casing, the casing comprising of a pair of vertical beams and the pair of hydraulic cylinders, wherein the pair of hydraulic cylinders comprises of a pair of vertically-oriented auxiliary hydraulic cylinders, the movable member coupled to the pair of vertical beams to restrict movement of the movable member in the non-vertical direction.

3. The work machine of claim 1, wherein the attachment further comprises:

auxiliary hydraulic cylinders, wherein actuating the auxiliary hydraulic cylinders performs one or more of tilting the work tool relative to the frame in a direction of roll about a forward portion of the boom assembly and angling the work tool relative to the frame in a direction of yaw about the forward portion of the boom assembly.

4. The work machine of claim 1, wherein the boom arms remain locked in a lowered position.

5. The work machine of claim 1, wherein the work tool is one of a blade, and a fork.

6. The work machine of claim 1, wherein the work tool is one of a blade, and a fork.

7. A work machine extending in fore-aft direction, the work machine comprising:

a frame and a ground-engaging mechanism, the ground-engaging mechanism configured to support the frame on a ground surface;

a boom assembly coupled to the frame, the boom assembly having a pair of boom arms pivotally coupled to the frame; and an attachment coupled to a fore-section of the boom arms, the attachment comprising:

a guide rigidly coupled to a fore-section of the frame;

a movable member coupled to the guide, the movable member moveable relative to the frame by a pair of hydraulic cylinders, the guide restricting movement of the movable member in a non-vertical direction;

a work tool coupled to the movable member, wherein in actuating the pair of hydraulic cylinders engages the movable member, vertically lifting or lowering the work tool relative to the frame; and auxiliary hydraulic cylinders, wherein in actuating the auxiliary hydraulic cylinders performs one or more of tilting the work tool relative to the frame in a direction of roll about a forward portion of the boom assembly and angling the work tool relative to the frame in a direction of yaw about the forward portion of the boom assembly.

8. The work machine of claim 7, wherein the guide comprises of a vertical support surface, the vertical support surface perpendicular to the fore-aft direction, the movable member abutting the vertical support surface when the pair of hydraulic cylinders actuate in vertically lifting or lowering the work tool.

9. The work machine of claim 7, wherein the guide comprises of a casing, the casing comprising of a pair of vertical beams and the pair of hydraulic cylinders, wherein the pair of hydraulic cylinders comprises of a pair of vertically-oriented auxiliary hydraulic cylinders, the movable member coupled to the pair of vertical beams to restrict movement of the movable member in the non-vertical direction.

10. The work machine of claim 7, wherein the boom arms remain locked in a lowered position.

* * * * *